US008916788B2

(12) United States Patent
Loitz et al.

(10) Patent No.: US 8,916,788 B2
(45) Date of Patent: Dec. 23, 2014

(54) SWITCH DEVICE

(75) Inventors: Joachim-Günther Loitz, Alzey (DE); Friedrich Hein, Mainz (DE); Michael Fuchs, Alzey-Weinheim (DE); Christophe Gehannin, Wiesbaden (FR)

(73) Assignee: GM Global Technology Operations LLC, Detroit, MI (US)

( * ) Notice: Subject to any disclaimer, the term of this patent is extended or adjusted under 35 U.S.C. 154(b) by 253 days.

(21) Appl. No.: 13/352,379

(22) Filed: Jan. 18, 2012

(65) Prior Publication Data

US 2012/0193198 A1 Aug. 2, 2012

(30) Foreign Application Priority Data

Jan. 20, 2011 (DE) ..... 10 2011 008 989

(51) Int. Cl.
*H01H 9/04* (2006.01)
*E05B 81/76* (2014.01)
*H01H 13/06* (2006.01)

(52) U.S. Cl.
CPC ..... *E05B 81/76* (2013.01); *H01H 2223/002* (2013.01); *H01H 13/06* (2013.01); *H01H 2009/048* (2013.01); *H01H 2221/044* (2013.01)
USPC ..... 200/302.1

(58) Field of Classification Search
CPC ..... H01H 19/06; H01H 9/02; H01H 13/04; H01H 19/04; H01H 21/04; H01H 3/16; H01H 9/00; H01H 9/20; H01H 5/18; H01H 5/00; H01H 1/02; H01H 1/10; H01H 13/02; H01H 13/62; H01H 13/70
USPC ..... 200/302.1–302.3, 303, 50.1, 406, 468, 200/511, 513, 522, 565, 293, 293.1, 295, 200/318, 329, 333, 339, 341, 345, 61.76, 200/61.81, 61.82
See application file for complete search history.

(56) References Cited

U.S. PATENT DOCUMENTS 6,626,473 B1 9/2003 Klein et al.
7,244,897 B2 7/2007 Villagrasa et al.

(Continued)

FOREIGN PATENT DOCUMENTS

DE 4208088 C1 4/1993
DE 10020172 A1 1/2001

(Continued)

OTHER PUBLICATIONS

UK IPO, British Search Report for Application No. 1121980.5, dated Mar. 22, 2012.

(Continued)

*Primary Examiner* — Renee S Luebke
*Assistant Examiner* — Anthony R. Jimenez
(74) *Attorney, Agent, or Firm* — Ingrassia Fisher & Lorenz, P.C.

(57) ABSTRACT

A switch device is provided for a wall element, such as a door, flap, or window, in particular for a vehicle, having a first housing part, which is positionable or positioned in or on the wall element, having a second housing part, which is particularly disc-shaped or plate-shaped, having a sealing apparatus, which is positionable or positioned at least between the first housing part and the second housing part and fixes the first housing part and the second housing part on one another so they are movable relative to one another, and having a switch element, which is positionable or positioned between the first housing part and the second housing part and can be actuated by a movement of the second housing part relative to the first housing part.

20 Claims, 4 Drawing Sheets

(56) References Cited

U.S. PATENT DOCUMENTS

| | | | | |
|---|---|---|---|---|
| 7,485,825 | B2 * | 2/2009 | Nishikawa et al. | 200/520 |
| 7,763,816 | B2 | 7/2010 | Buschmann | |
| 7,884,293 | B2 | 2/2011 | Ulomek | |
| 2005/0016826 | A1 | 1/2005 | Li | |
| 2006/0180447 | A1 | 8/2006 | Korultay et al. | |

FOREIGN PATENT DOCUMENTS

| | | | |
|---|---|---|---|
| DE | 102005015643 | A1 | 11/2006 |
| DE | 60306956 | T2 | 6/2007 |
| DE | 102006057034 | A1 | 7/2007 |
| DE | 102006024292 | A1 | 11/2007 |
| EP | 1579097 | A2 | 9/2005 |
| EP | 2051268 | A1 | 4/2009 |
| EP | 2090728 | A2 | 8/2009 |
| JP | 2006331813 | A | 12/2006 |

OTHER PUBLICATIONS

German Patent Office, German Search Report for Application No. 102011008989.6, dated Nov. 14, 2011.

* cited by examiner

SWITCH DEVICE

CROSS-REFERENCE TO RELATED APPLICATION

This application claims priority to German Patent Application No. 102011008989.6, filed Jan. 20, 2011, which is incorporated herein by reference in its entirety.

TECHNICAL FIELD

The technical field relates to a switch device for a wall element, such as a door, flap, or window, in particular for a vehicle, a sealing apparatus for such a switch device, and a method for actuating such a switch device.

BACKGROUND

The use of a switch device is known, for example, from a hatchback of a motor vehicle. It is used for the purpose of manually unlocking or locking the hatchback in order to open the hatchback.

A switch device is known from DE 10 2006 057 034 A1. A snap dome of this switch device cooperates with a micro switch in such a manner that the micro switch is actuated in the event of pressure on the snap dome. It is disadvantageous in a case that a substantial actuating force is to be applied when pressing on the snap dome. In addition, penetration of moisture and/or dirt into the switch device can never be entirely prevented in the case of the known switch device.

At least one object is to propose a switch device, which is simple to actuate and in which the danger of penetration of dirt and/or moisture is reduced. In addition, other objects, desirable features, and characteristics will become apparent from the subsequent summary and detailed description, and the appended claims, taken in conjunction with the accompanying drawings and this background.

SUMMARY

A switch device is provided for a wall element, such as a door, flap, or window, in particular for a motor vehicle, having a first housing part, which is positionable or positioned in or on the wall element, having a second housing part, which is disc-shaped or plate-shaped in particular, having a sealing apparatus, which is positionable or positioned at least between the first housing part and the second housing part and fixes the first housing part and the second housing part on one another so they are movable relative to one another, and having a switch element, which is positionable or positioned between the first housing part and the second housing part and can be actuated by moving the second housing part relative to the first housing part.

The first housing part can be positioned removably or permanently in or on the wall element. However, it is preferable for the first housing part to be positioned removably, for example, by a screw connection or bolt connection, in a depression on the wall element. In such a case, a visually appealing exterior is achieved. The second housing part can comprise an arbitrary shape. However, it is preferable if it is implemented as disc-shaped or plate-shaped. In addition, an emblem or trademark can be positioned on the side of the second housing part facing away from the first housing part, for example. This also results in a visually appealing exterior.

The movement of the second housing part relative to the first housing part can comprise a movement of the second housing part in the direction toward the first housing part or away therefrom. This movement can comprise a translational or rotational movement, for example.

Furthermore, it is conceivable that the first housing part and the second housing part are additionally indirectly or directly connected to one another, for example, by a hook connection. In such a case, it is preferable if this connection has sufficient play that a relative movement of the second housing part to the first housing part is permitted.

The sealing means can cover the first housing part entirely or only in one section. However, it is preferable if the sealing apparatus covers the first housing part essentially entirely in the direction toward the wall element. The danger of penetration of dirt or moisture that has reached behind the switch device is reduced in this way. Fundamentally, the sealing apparatus can be removably or permanently connected to the first housing part. For example, it can be stretched like a skin over the first housing part.

In another embodiment, the first housing part, the second housing part, and the sealing apparatus together form a closed system, which is sealed to the outside. Penetration of moisture and/or dirt into the switch device is avoided in this way.

In another embodiment, the switch device additionally comprises a holding apparatus, in particular having a holding ring, which comprises at least one first holding means on the sealing apparatus and at least one second holding means on the second housing part, using which the second housing part is connectable or connected to the sealing apparatus. Because the second housing part is connectable to the sealing apparatus, the first housing part and the second housing part are fixed on one another. In another embodiment, the holding apparatus is positioned inside and/or outside the system made of first housing part, second housing part, and sealing apparatus. In such a case, the at least one first holding means and the at least one second holding means can be positioned outside or inside the system. In addition, the holding means can be provided both inside and outside.

The holding apparatus can be positioned as desired inside and/or outside the system made of first housing part, second housing part, and sealing apparatus. However, it is preferable if it at least sectionally continues an outer contour or inner contour of the system, for example, a border course and/or an edge course. In such a case, it can have a linear or curved section, for example. If it has a curved section, it has proven to be advantageous if the holding apparatus has a holding ring. This can readily be positioned easily on the sealing apparatus or can be part of the sealing apparatus. The holding ring is preferably positioned on the surface of the sealing apparatus facing away from the second housing part.

The first holding means and the second holding means can fundamentally be implemented as desired. However, it is preferable if the at least one first holding means of the holding apparatus comprises at least one opening, into which the second holding means of the second housing part, which is implemented as at least one projection, is insertable, in particular to form an undercut. In such a case, the second housing part can be readily clipped onto the sealing apparatus.

In addition, it is conceivable that the first holding means has multiple openings and/or the second holding means has multiple projections. The strength of the connection of first housing part and second housing part can be increased in this way. The openings can fundamentally have any desired shape; in particular, they can be round, oval, or rectangular. If the holding apparatus continues an edge course and/or wall course, it has proven to be expedient if openings and/or projections are positioned regularly or irregularly along the course. In particular, if the outer contour continued by the holding apparatus is circular, it has proven to be advantageous if two adjacent openings enclose an angle of less than approximately 180°, preferably less than approximately 90°, preferably less than approximately 45°, preferably less than approximately 30°, preferably less than approximately 15°, in relation to the center of the cross-section of the first housing part and/or the second housing part.

The components of the switch device can each be formed from any desired material. However, it has proven to be cost-effective if the first holding means, in particular the holding ring, and/or the second holding means and/or the first housing part and/or the second housing part and/or the sealing apparatus comprise a soft plastic component or a hard plastic component.

An embodiment of the switch device is particularly preferred in which the first housing part and the second housing part as well as the holding ring and the second holding means comprise a hard plastic component and the sealing apparatus is formed by a soft plastic component.

If the sealing apparatus comprises a soft plastic component, it is preferably elastically deformable. In such a case, first housing part and second housing part are readily movable relative to one another. The first housing part can fundamentally be positioned in any desired way on or in the wall element. However, it is preferable if the switch device is fixed by means of a screw connection or bolt connection on the wall element. In such a case, it has proven to be advantageous if the sealing apparatus and/or the first housing part have at least one through opening, using which the switch device is fixable on or in the wall element. Screws and/or bolts are readily insertable through the through openings. The through opening is particularly implemented as corresponding to an insertable bolt or screw. The sealing action is increased in this way.

In addition, it is conceivable that at least one protrusion, in particular implemented as a bolt or screw, is provided on the surface of the first housing part facing toward the wall element. This protrusion is preferably insertable through the through opening into the sealing apparatus.

In another embodiment, it is provided that at least one stop is provided between the first housing part and the second housing part, which delimits the movement, in particular the rotation, of the second housing part relative to the second housing part, the switch device always being sealed to the outside. For example, the stop can be formed by the switch element or a receptacle for the switch element, which prevents a further movement of the second housing part when the first housing part has moved the switch element into the actuated position.

The sealing apparatus can essentially guides the movement of the second housing part relative to the first housing part. However, it has proven to be advantageous if a bearing apparatus is positioned between the first housing part and the second housing part, in particular if the first housing part has a first bearing means and the second housing part has a second bearing means. In such a case, the movement of the second housing part relative to the first housing part is supported, in particular guided, by the bearing apparatus. The bearing apparatus can release at least one rotation around at least one spatial axis for this purpose. It is particularly preferable if the first bearing means and the second bearing means cooperate like a hinge.

The rotational axis of the bearing apparatus can fundamentally be positioned as desired, in particular can comprise a rotation around an axis positioned parallel to the surface or an axis positioned perpendicularly thereto. However, it is preferable if the rotational axis runs eccentrically to the center of the cross-section of the first housing part and/or the second housing part and in particular parallel to a surface on which the vehicle moves. A lever arm is formed in this way, which allows easy and reduced-force actuation of the switch device. Through the eccentric positioning of the rotational axis, comfortable actuation is possible, for example, by a user with low force application.

Furthermore, the switch device additionally has at least one guide apparatus, which is formed in particular by at least one first guide web on the first housing part and at least one second guide web on the second housing part, and/or a receptacle for the switch element. The relative movement of the second housing part to the first housing part may be supported in a simple way by the guide apparatus.

In another embodiment, the switch element comprises a micro switch. In such a case, the switch device can be implemented as space saving and compact. To switch it on and off, the switch element is switched in each case by a user by moving the second housing part relative to the first housing part. However, it has proven to be advantageous if the switch element comprises a restoring apparatus, in particular a leaf spring, which automatically returns it from an actuated position into a non-actuated position.

In another embodiment, the restoring apparatus is positioned between the first housing part and the second housing part, in particular between the first housing part and the switch element. In such a case, the switch element and the restoring apparatus are positioned inside the system of the first housing part, the second housing part, and the sealing apparatus and protected from moisture and/or soiling in relation to the environment.

A sealing apparatus is also provided for fixing a first housing part to a second housing part so they are movable relative to one another, which is suitable for being used in a switch device having the above-mentioned features. In addition, a method is provided for actuating a switch device, having a first housing part, a second housing part, and a sealing means positioned between first housing part and second housing part, in which: a) the first housing part and the second housing part are fixed on one another by the sealing apparatus; b) the second housing part is movable relative to the first housing part, in particular manually, if a force acts, in particular manually, on the switch device; c) a switch element is actuated by the relative movement; and d) the switch element is pretensioned by a tensioning apparatus in a non-actuated base position so that it is moved back into the non-actuated base position when the second housing part and/or the first housing part are force-free.

The switch device has numerous advantages. For example, because the second housing part is fixed by means of the sealing apparatus on the first housing part, a simple and flexible connection is provided between the first housing part and the second housing part. This allows a compact construction with low weight and low production costs. Because the rotational axis of the bearing apparatus is positioned eccentrically, the switch device can be actuated using a small actuating force. By using a sealing apparatus and positioning the switch element inside the system, consisting of first housing part, second housing part, and sealing apparatus, the switch device, in particular the switch element is protected against moisture and/or soiling.

BRIEF DESCRIPTION OF THE DRAWINGS

The present invention will hereinafter be described in conjunction with the following drawing figures, wherein like numerals denote like elements, and.

DETAILED DESCRIPTION

The following detailed description is merely exemplary in nature and is not intended to limit application and uses. Furthermore, there is no intention to be bound by any theory presented in the preceding background or summary or the following detailed description.

Figure 1A:
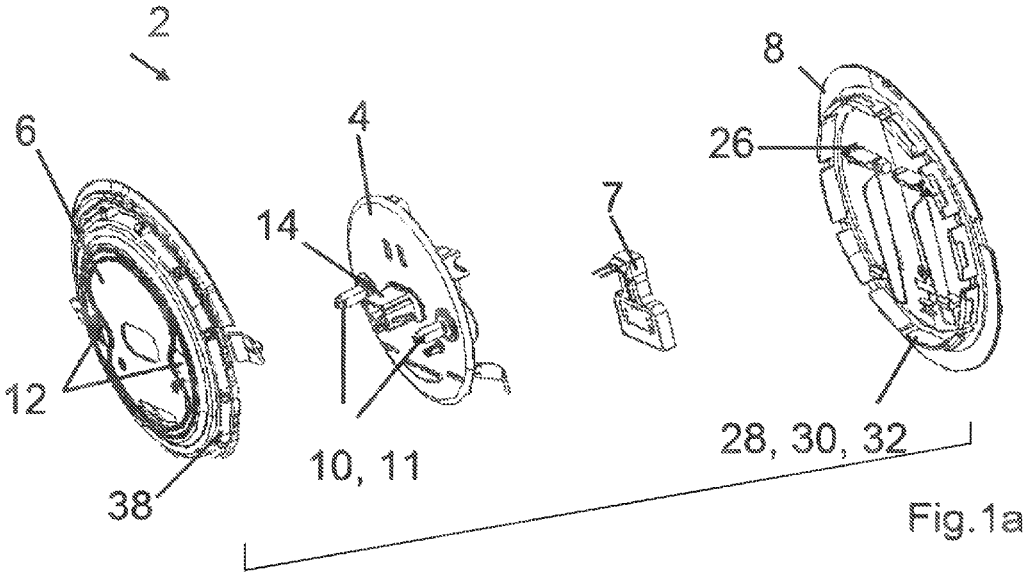
FIG. 1*a* and FIG. 1*b* show a perspective, exploded view of the switch device according to an embodiment.
Figure 1B:
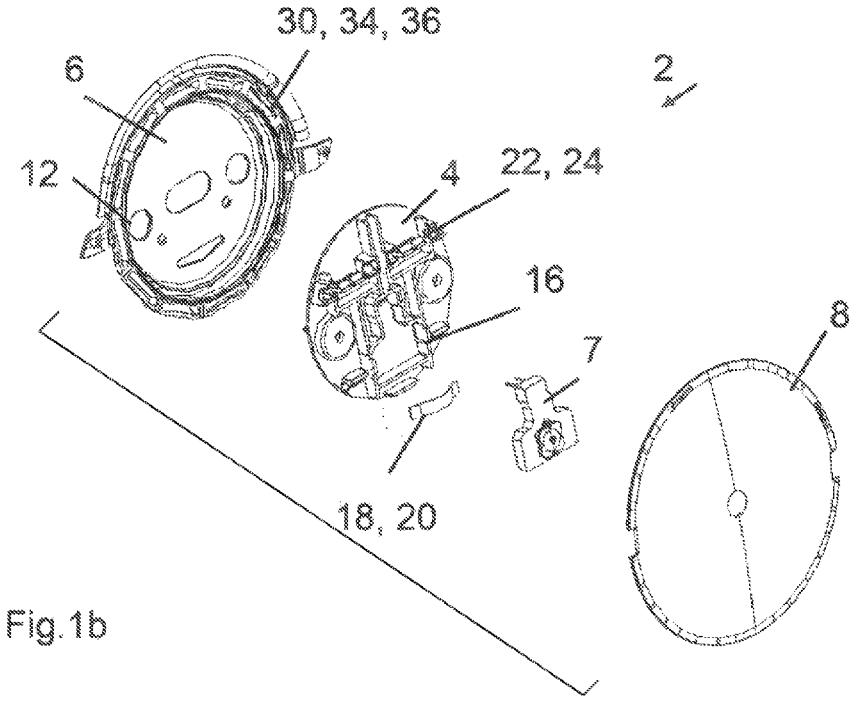

FIG. 1*a* and FIG. 1*b* show a switch device, which is provided as a whole with the reference sign 2. The switch device 1 is suitable for positioning on a wall element 3 (shown in FIG. 6*a* to FIG. 6*c*), such as a door, flap, or window, in particular of a motor vehicle. The switch device 2 has a first housing part 4, which is enclosed by a sealing apparatus 6. The first housing part 4 is sealed essentially entirely in the direction toward the wall element 3 in the sealing apparatus 6. The first housing part 4 additionally forms a receptacle for a switch element 7, using which, for example, an unlocking and/or locking device of a motor vehicle can be activated. In addition, the switch device 2 has a second housing part 8, which is movable relative to the first housing part 4.

FIG. 1*a* and FIG. 1*b* show an embodiment of the individual components of the switch device 2, in which two protrusions 11, which are implemented as bolts 10, are positioned on the first housing part 4 on the surface facing toward the wall element 3, using which the switch device 2 is fixable on the wall element 3. The two bolts 10 are insertable through complementary implemented openings 12 in the sealing apparatus 6.

In addition, the first housing part 4 has a contact guide 14, using which the contacts of the switch element 7 are connectable to the unlocking and/or locking device. On the side of the first housing part 4 facing away from the wall element 3, it has a receptacle 16, in which the switch element 7 is positionable. In order to automatically return the switch element 7 from an actuated position into a non-actuated position, a restoring apparatus 20, which is implemented as a leaf spring 18, is additionally positioned in the receptacle 16. According to the view in FIG. 1*b*, it is positioned between the first housing part 4 and the switch element 7. In addition, the first housing part 4 has a first bearing means 22 of a bearing apparatus 24, using which the second housing part 8 is connectable to second bearing means 26 of the bearing apparatus 24. It is positioned eccentrically in relation to the center of the cross-section of the first housing part 4. The second housing part 8 is mounted so it is rotatable around a rotational axis 27 via the bearing apparatus 24.

The second housing part 8 essentially has a disc-like shape. A second holding means 28 of a holding apparatus 30 is positioned on the surface of the second housing part 8 facing toward the first housing part 4. It is formed by projections 32. The second housing part 8 is insertable into first holding means 36 of the holding apparatus 30, which is implemented by openings 34, using this second holding means 28 formed by projections 32. In this way, the second housing part 8 is fixed on the sealing apparatus 6. Openings 34 and projections 32 are implemented as essentially complementary to one another.

In the exemplary embodiment shown in FIG. 1*a* and FIG. 1*b*, the first holding means 36 comprises a holding ring 38, which preferably comprises a hard plastic component. The holding ring 38 is preferably positioned on the surface of the sealing apparatus 6 facing away from the second housing part.

Figure 2:
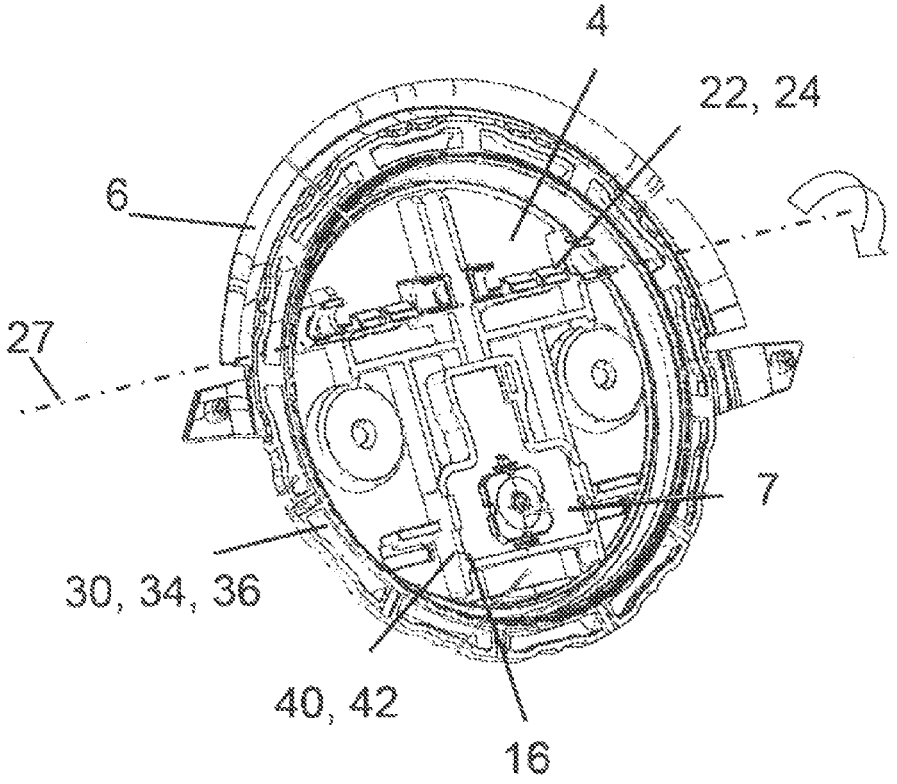
FIG. 2 shows a perspective view of the first housing part having sealing apparatus and switch element.

FIG. 2 shows a perspective view of the first housing part 4, which is positioned in the sealing apparatus 6 and in which the switch element 7 is received in the receptacle 16. It is clear from FIG. 2 that the sealing apparatus 6 essentially entirely encloses the first housing part 4, in particular continues the edge contour of the first housing part 4 outward.

Figure 3:
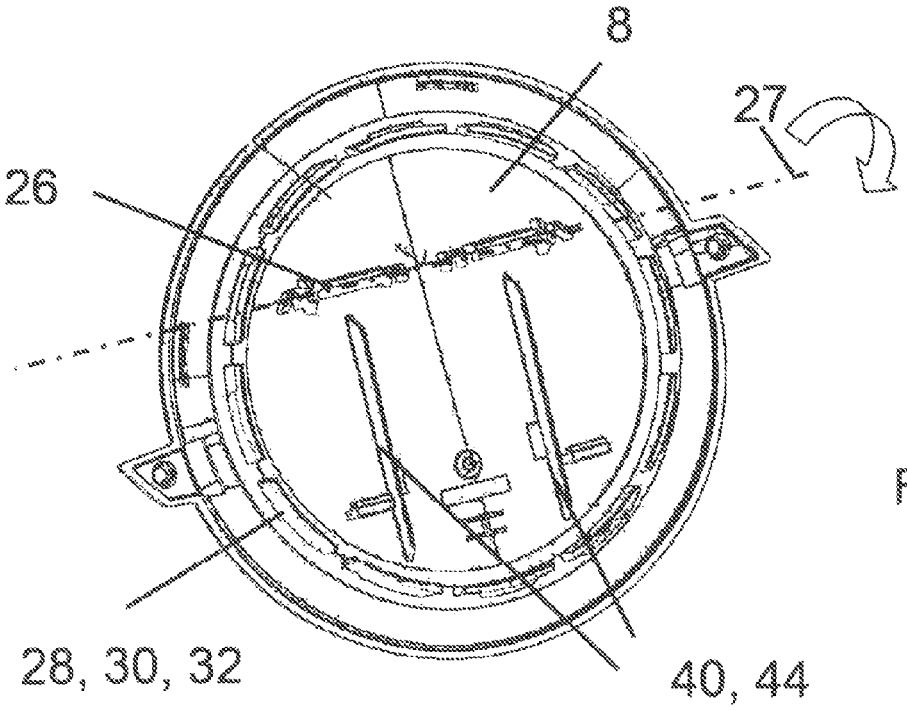
FIG. 3 shows a perspective view of the second housing part.

FIG. 3 shows a perspective view of the second housing part 8. Identical parts are provided with identical reference numerals, so that reference is made to the description of FIG. 1*a* and FIG. 1*b* to avoid repetitions. A guide apparatus 40 is additionally formed between the first housing part 4 and the second housing part 8, which comprises first guide webs 42 in the first housing part 4 and second guide webs 44 in the second housing part 8. The second housing part 8 slides along the guide webs 42, 44 during the relative movement in relation to the first housing part 4.

Figure 4:
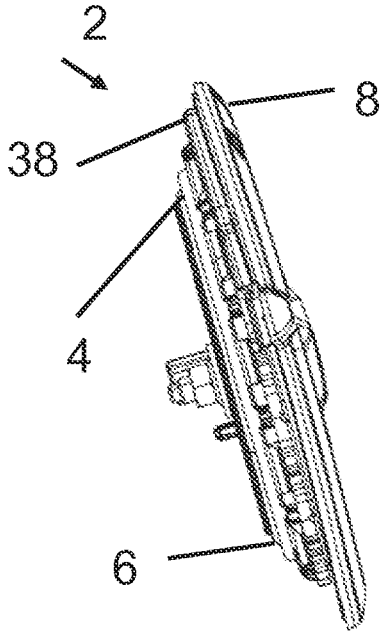
FIG. 4 shows a side view of the switch device according to an embodiment from FIG. 1.
Figure 5:
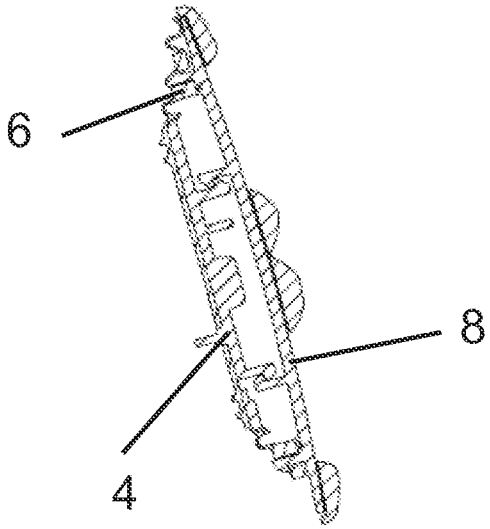
FIG. 5 shows a sectional view of the switch device from FIG. 4 along an eccentric sectional axis.

FIG. 4 shows a side view of the switch device 2. It is obvious from FIG. 4 that the switch device 2 can be implemented particularly compactly. FIG. 5 shows a sectional view along an eccentric section line according to FIG. 4. FIG. 5 shows that, in addition to the fixing of the second housing part 8 on the sealing apparatus 6, a direct connection additionally exists between the first housing part 4 and the second housing part 8 by means of the holding apparatus 30. This connection is formed by at least one hooked connection 46, which permits sufficient play to allow a relative movement of the second housing part 8 to the first housing part 4.

Figure 6A:
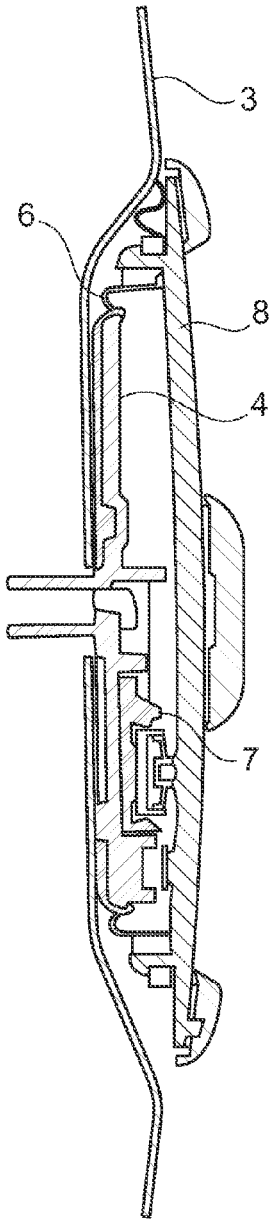
FIG. 6*a* to FIG. 6*c* show the switch device according to an embodiment in various positions of the second housing part.
Figure 6B:
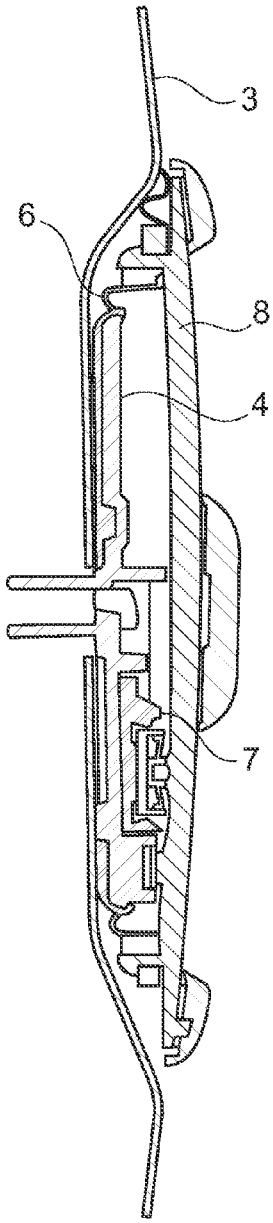
Figure 6C:
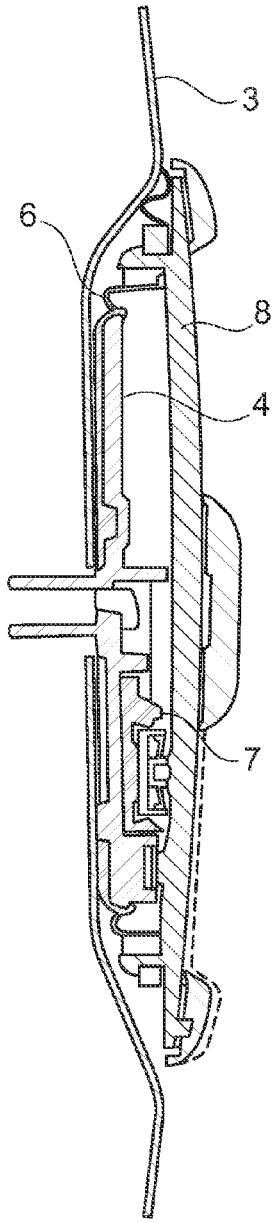

The mode of operation of the switch device 2 is described in detail based on FIG. 6*a* to FIG. 6*c*. FIG. 6*a* shows the switch device 2 in a non-actuated base position. In this case, the second housing part 8 is unmoved in relation to the first housing part 4. The switch element 7 is located in a non-actuated base position.

FIG. 6*b* shows the switch device 2, in which the second housing part 8 has been relatively moved in the direction toward the first housing part 4. The switch element 7 is located in this case in an actuated position. The receptacle 16 delimits the movement of the second housing part 8 in the actuation direction and forms a stop for the second housing part 8.

FIG. 6*c* shows a superposition of FIG. 6*a* and FIG. 6*b*. A minimal relative movement of the second housing part 8 in the direction toward the first housing part 4 is sufficient to actuate the switch element 7.

The features of the invention disclosed in the above description, in the claims, and in the drawings can be essential both individually and in any arbitrary combination for implementing the invention in its various embodiments. In addition, while at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A switch device for a wall element in for a vehicle, comprising:

a first housing part in a position with respect to the wall element, wherein the first housing part is plate-shaped defining a first face facing the wall element and a second face opposite the first face;

a second housing part;

a sealing apparatus in a second position at least between the first housing part and the second housing part and configured to fix the first housing part and the second housing part on one another so the first housing part and the second housing part are movable relative to one another, wherein the sealing apparatus essentially entirely covers the first face of the first housing part; and a switch element in a third position between the first housing part and the second housing part and configured to actuate by a movement of the second housing part relative to the first housing part, wherein the second housing part has a third face such that the first face of the first housing part and the third face of the second housing part each face a first direction, toward the wall element, and wherein the first housing part is between the second housing part and the wall element when viewed in the first direction.

2. The switch device according to claim 1, wherein the wall element is a door.

3. The switch device according to claim 1, wherein the wall element is a window.

4. The switch device according to claim 1, wherein the second housing part is disc-shaped.

5. The switch device according to claim 1, wherein the second housing part is plate-shaped.

6. The switch device according to claim 1, wherein the switch device further comprises a holding apparatus with at least one first holder on the sealing apparatus and at least one second holder on the second housing part which are configured to connect the second housing part to the sealing apparatus.

7. The switch device according to claim 6, wherein the holding apparatus is positioned inside a system made of the first housing part, the second housing part, and the sealing apparatus.

8. The switch device according to claim 6, wherein the at least one first holder comprises an opening into which the at least one second holder that is implemented as at least one projection is insertable to form an undercut.

9. The switch device according to claim 6, wherein the at least one first holder comprises a plastic component.

10. The switch device according to claim 1, wherein the sealing apparatus and the first housing part comprise a through opening in which the switch device is fixable with respect to the wall element.

11. The switch device according to claim 1, further comprising a stop between the first housing part and the second housing part that is configured to limit the movement of the second housing part relative to the first housing part.

12. The switch device according to claim 1, further comprising a bearing apparatus positioned between the first housing part and the second housing part.

13. The switch device according to claim 12, wherein a rotational axis of the bearing apparatus extends eccentrically to a center of a cross-section of the first housing part.

14. The switch device according to claim 1, further comprising a guide apparatus that is formed by first guide webs on the first housing part and by second guide webs formed on the second housing part.

15. The switch device according to claim 1, wherein the switch element comprises a micro switch configured to return the switch element from an actuated position into a non-actuated position.

16. The switch device according to claim 11, further comprising a restoring apparatus positioned between the first housing part and the second housing part.

17. A method for actuating a switch device on a wall element, the switch device having a first housing part, a second housing part, and a sealing apparatus positioned between the first housing part and the second housing part, the method comprising:

fixing the first housing part to the second housing part with the sealing apparatus, wherein the first housing part is plate-shaped defining a first face facing the wall element and a second face opposite the first face such that the sealing apparatus essentially entirely covers the first face of the first housing part, wherein the second housing part has a third face such that the first face of the first housing part and the third face of the second housing part each face a first direction, toward the wall element, and wherein the fixing the first housing part to the second housing part includes fixing the first housing part between the second housing part and the wall element when viewed in the first direction;

moving the second housing part relative to the first housing part when a force acts on the switch device;

actuating a switch element by the moving the second housing part relative to the first housing part; and pre-tensioning the switch element with a tensioning apparatus in a non-actuated base position, so that the switch element is moved back into the non-actuated base position.

18. The switch device according to claim 1, wherein the first housing part is defined by a first outer edge with a first circumference and the second housing part is defined by a second outer edge with a second circumference, the second circumference being greater than the first circumference.

19. The switch device according to claim 18, wherein the second outer edge circumscribes the first outer edge.

20. The switch device according to claim 1, wherein the switch element is offset relative to a center of the first housing part.

* * * * *